US005932967A

United States Patent [19]

Chikazawa

[11] Patent Number: 5,932,967

[45] Date of Patent: Aug. 3, 1999

[54] PLASMA DISPLAY PANEL

[75] Inventor: Yoshiharu Chikazawa, Yokohama, Japan

[73] Assignee: Thomson multimedia S.A., Boulogne Cedex, France

[21] Appl. No.: 08/769,921

[22] Filed: Dec. 19, 1996

[30] Foreign Application Priority Data

Dec. 28, 1995 [GB] United Kingdom ..... 9526603

[51] Int. Cl.[6] ..... H01J 17/49

[52] U.S. Cl. ..... 313/582; 313/586; 313/587

[58] Field of Search ..... 313/484–85, 493, 313/582, 584, 586–87, 634–35, 110, 112, 113; 359/245, 247, 252–54, 265, 272–73

[56] References Cited

U.S. PATENT DOCUMENTS

| | | | |
|---|---|---|---|
| 4,224,553 | 9/1980 | Hellwig | 313/489 |
| 4,692,662 | 9/1987 | Wada et al. | 313/493 |
| 4,803,402 | 2/1989 | Raber et al. | 313/587 |
| 4,827,186 | 5/1989 | Knauer et al. | 313/485 |
| 5,182,489 | 1/1993 | Sano | 313/584 |

FOREIGN PATENT DOCUMENTS

| | | | |
|---|---|---|---|
| 2-242548 | 9/1990 | Japan | H01J 17/16 |
| 4-269427 | 9/1992 | Japan | H01J 17/06 |
| 4-332430 | 11/1992 | Japan | H01J 17/49 |
| 2047949 | 12/1980 | United Kingdom | H01J 17/49 |

OTHER PUBLICATIONS

Patent Abstracts of Japan, vol. 14, No. 560 (E–1012), p. 105 (Dainippon Printing).

Patent Abstracts of Japan, vol. 17, No. 61 (E–1316), p. 162 (Oki Electric).

Patent Abstracts of Japan, vol. 17, No. 178 (E–1347), p. 94 (Fujitsu).

UK Search Report dated: Feb. 22, 1996.

*Primary Examiner*—Sandra O'Shea
*Assistant Examiner*—Mack Haynes
*Attorney, Agent, or Firm*—Joseph S. Tripoli; Dennis H. Irlbeck

[57] ABSTRACT

A plasma display panel is formed by a front plate and a back plate spaced apart from one another so that a discharge space is formed to accommodate a plurality of light generating display cells. To increase the luminance on the front side of the plasma display panel a mirror surface or a plurality of mirror surfaces is provided at the back side of the plasma display panel and/or at side-walls of cells of the plasma display panel.

6 Claims, 3 Drawing Sheets

PLASMA DISPLAY PANEL

The present invention relates to a plasma display panel (PD), in particular to a plasma display panel comprising a front plate and a back plate spaced apart from one another so that a discharge space is generated to accommodate a plurality of independent light generating display cells.

BACKGROUND OF THE INVENTION

Such plasma display panels are known, for example from Japanese Patent Application No. 62-276678 or EP-OS 0 575 222. Presently many efforts are made to improve the luminance of the plasma display panels. In a display cell of a plasma display panel ultra-violet (UV) rays are generated by a gas discharge and the UV rays are incidenting on at least one phosphorous layer to convert the UV rays into visible rays. As can be seen from the gas discharge, the UV light rays are generated in all directions of space. In order to improve the luminance of the plasma display panel it is possible to improve the discharge, which in turn will need an extra large electric current and in consequence the UV ray intensity will be large and therefore hard to handle. Furthermore, it is possible to improve the conversion layers, i.e. the phosphorous layers. As a further possibility the display cell structure can be improved. But all of the above proposed possible ways of improvement need additional technical sophisticated measures, which leads to an increase in production costs.

It is therefore the object of the present invention to provide a cost effective improvement of the luminance of a plasma display panel.

SUMMARY OF THE INVENTION

A plasma display panel comprising a front plate and a back plate spaced apart from one another so that a discharge space is formed to accommodate a plurality of light generating display cells, characterized in that the back side of the plasma display panel and/or side-walls of the display cells include a mirror layer having a controllable reflectivity which layer is realized as liquid crystal.

In a plasma display panel, light, which being also in the non-visible range of UV is generated by a discharge of a gas in a display cell of the panel. The discharge is generated by a voltage across the front side and back side of the display cell, which is for example applied to a front electrode and a back electrode. The UV light generated by the gas discharge has in general a uniform distribution in space. The UV rays are converted into visible rays by conversion layers, normally made of phosphorous, the layers being mainly located at the front and back side of the display cell. These visible rays leave the display cell through the front plate and through the back plate. It is therefore possible to see the generated picture on both sides of the plasma display panel. But the visible light leaving the plasma display panel through the back plate is lost and does not increase the luminance of the plasma display panel. To use these "lost rays" a mirror is provided at the back side and/or at side-walls of the plasma display panel, so that at least most of such rays generated by the discharge, may be visible or non-visible rays, and radiated to directions other than to the front, are reflected and redirected to the front plate of the plasma display panel so that they can further increase the luminance of the display.

The mirror can be arranged on the outside surface or on the inside surface of the back plate or can even be integrated in the back plate. This means that the mirror can also be sandwiched by the material of the back plate or the back plate can be made of material which may be reflective for the light generated by the discharge, may be visible or non-visible light.

Alternatively, or in addition, mirror means can be provided in the area of at least one side-wall of the cells of a plasma display panel. The mirror means can be arranged on the outside surface or on the inside surface of the side-wall or can even be integrated in the side-wall. This means that the mirror means can also be sandwiched by the material of the side-wall or the side-wall can be made of material which may be reflective for the light generated by the discharge, may be visible or non-visible light.

A further realisation of the invention includes mirror means, reflectivity of which is controllable. According mirror means can be realised e.g. as liquid crystal (LC) means, which change transmissivity and reflectivity. The LC can be set on the backglass of the PDP.

This realisation has following advantages. When the PDP dot emits light by the applied image, the LC cell reflectivity is changed to high, and the transmissivity is changed to low. Therefore emitted light from the PDP dot through the back-glass is reflected by the LC, and is directed through the front-glass into the direction of a viewer. When the PDP does not emit light by the applied image, the LC reflectivity is changed to low, and the transmissivity is changed to high. Therefore noise light from outside or other dots goes through the back-glass and to the LC. As the reflectivity of a black-glass is very low, the noise light will be absorbed, may be partly or even nearly complete. Thereby the contrast and the luminance of the PDP can be improved. Also the black level of an image to be displayed can be improved.

Depending on the type of display used, i.e. AC- or DC-type plasma panel display, the mirror surface can covered by an insulation layer, if the mirror surface is provided inside of the plasma panel display. Preferably said insulation layer is made of phosphorous.

Preferably the plasma display panel comprises a back electrode located at the back side of the display cell, wherein the electrode is covered with a mirror surface.

To generate controllable display cells in a plasma panel display, the discharge space of the plasma panel display is separated by a plurality of ribs, which are preferably arranged perpendicular to each other.

Such a plasma display panel further comprises a front electrode and conversion layers to convert the UV light into visible light. Said conversion layers are preferably made of phosphorous.

BRIEF DESCRIPTION OF THE DRAWINGS

Preferred embodiments of the invention are now described with reference to the accompanying drawings, wherein.

DESCRIPTION OF THE PREFERRED EMBODIMENTS

In the following figures same parts are referred to by the same reference numbers and a repeating description will be omitted.

Figure 1:
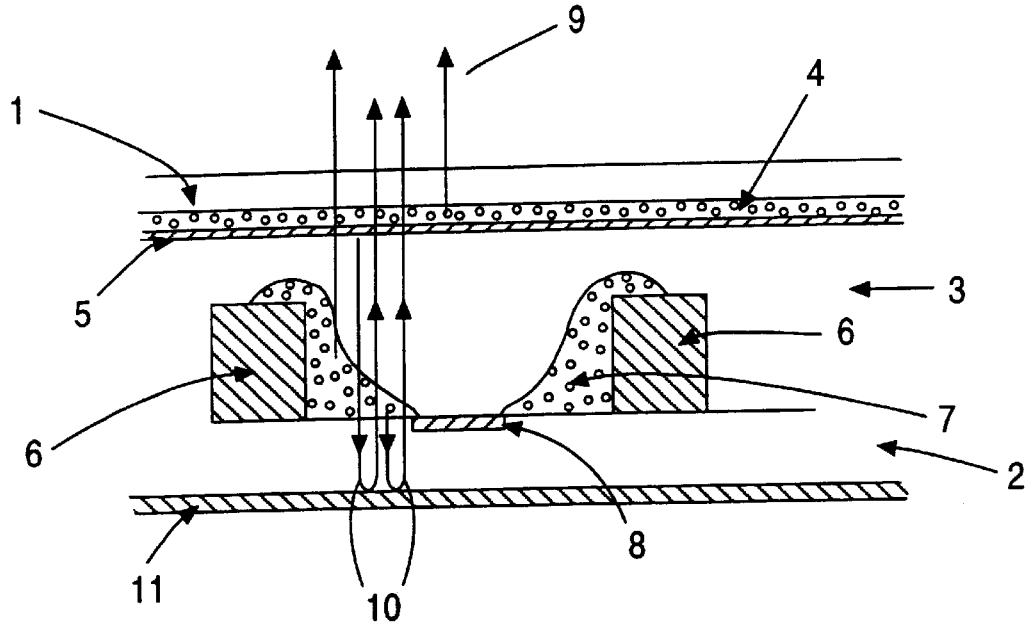
FIG. 1 shows a cross-section of a first embodiment of a display cell of a plasma display panel.

FIG. 1 shows a cross-section through one display cell of a plasma display panel. Such a plasma display panel is formed by a front plate 1 and a back plate 2, which are spaced from one another to create a display space 3. Usually such front and back plates 1, 2 are made of glass. Individually controllable display cells are formed with a plurality of ribs 6, which are arranged in a mutually perpendicular way. The discharge space 3 is filled with a suitable discharge gas, including e.g. neon (Ne) and xenon (Xe) or any other gas composition, as is well known by a person skilled in the art. The gas discharge is generated between a front electrode 5 and a back electrode 8 arranged on the front plate 1 and the back plate 2, respectively. Because the light generated by the gas discharge includes also a range within the UV region, conversion layers 4 and 7 are needed to convert the UV light into visible light. The conversion layers 4 and 7 are normally made of phosphorous. In the present example the plasma display panel contains a conversion layer 4 located at the inside of the front plate 1 and a conversion layer 7 located mainly at the back side and the ribs of the display cell, so that the back electrode 8 in or on the back plate 2 remains uncovered. From the conversion layers 4 and 7 visible rays 9 and 10 emanate. Because the outer surface of the back plate 2 is provided with a mirror surface 11, light which would otherwise leave the plasma panel display through the back plate 2 is reflected and redirected to the front side of the plasma panel display.

Figure 2:
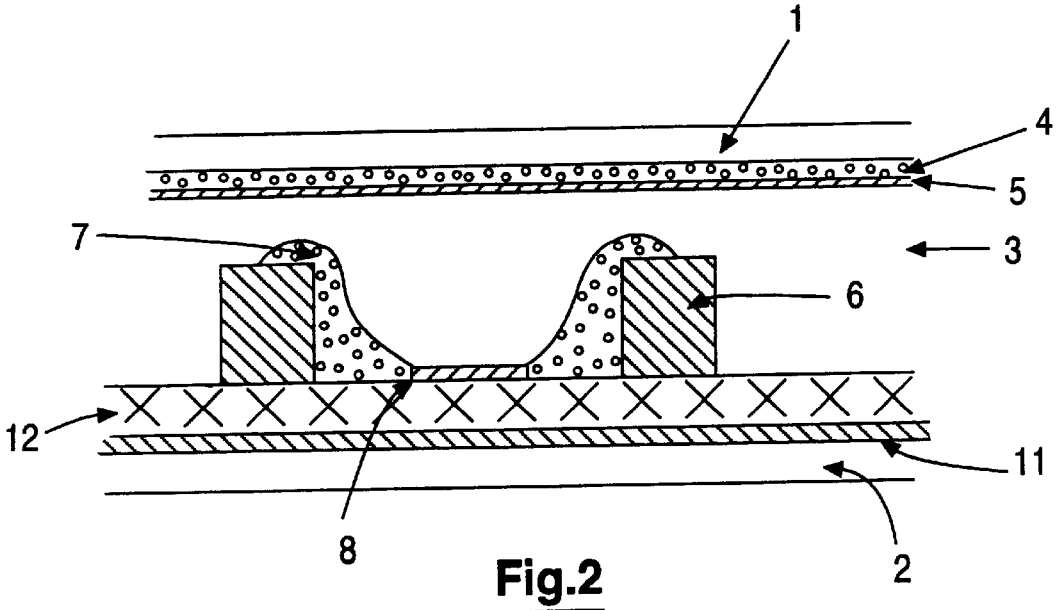
FIG. 2 shows a cross-section of a second embodiment of a display cell of a plasma display panel.

FIG. 2 shows a second embodiment of a display cell of a plasma display panel, wherein the main difference to the embodiment according to FIG. 1 is that the mirror surface is located on the inside surface of the back plate 2. If the mirror surface is a conductive material, an insulation layer 12 located on top of the mirror surface is required. The insulation layer 12 is not necessary if the mirror surface is not made of a conductive material. The insulation layer material can be phosphorous.

Figure 3:
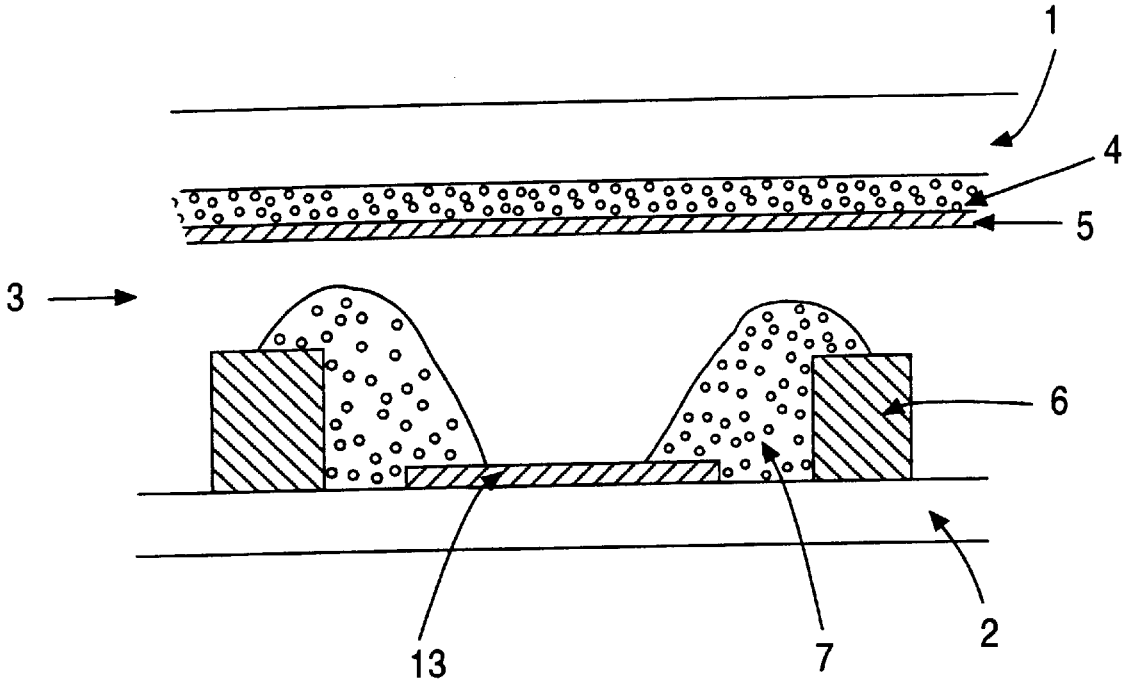
FIG. 3 shows a cross-section of a third embodiment of a display cell of a plasma display panel.

FIG. 3 shows a third embodiment of a display cell of a display panel according to the invention in cross-section. Here the back electrodes 13 located on the inner side of the back plate 2 is enlarged and the surface of the electrode is polished so that it acts as a mirror. Another possibility is to cover the back electrode with a mirror surface to reflect the light rays to the front side. In the case of polishing the surface this is possible if the electrode is made for example of aluminum, nickel or the like.

Figure 4:
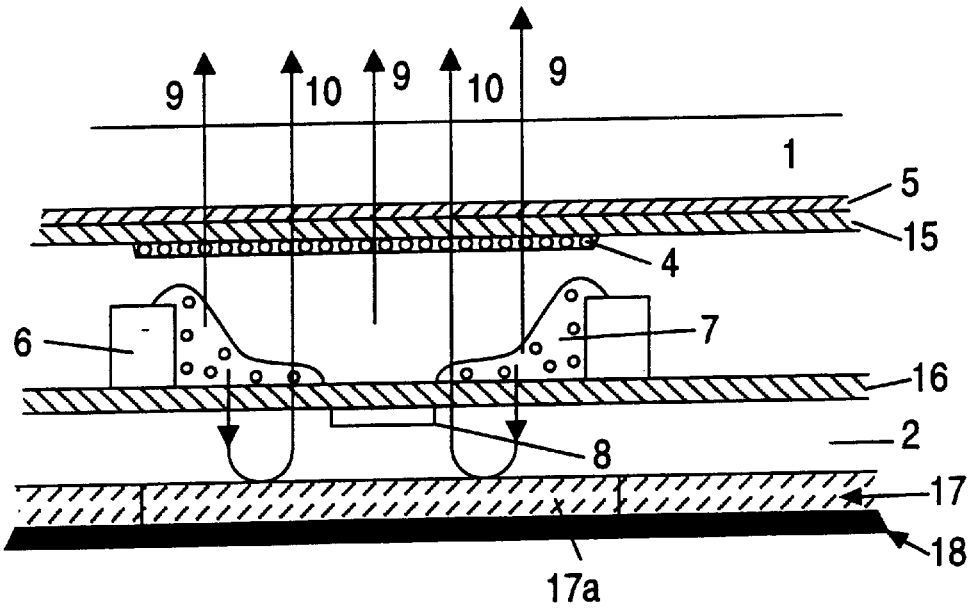
FIG. 4 shows a further embodiment having LC as mirror.

FIG. 4 shows a further embodiment, where the mirror surface is replaced by a controllable mirror, e.g. a liquid crystal layer (LC) 17 and a black-plate 18. The LC 17 is arranged in a number of LC-cells 17*a*.

Figure 6:
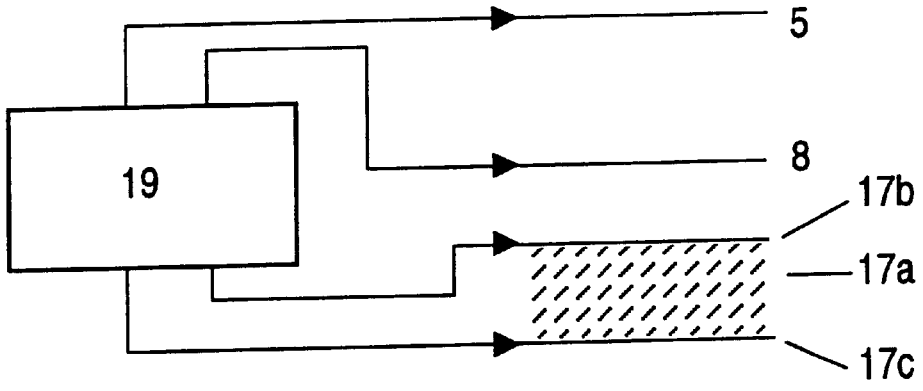
FIG. 6 shows a possible arrangement for controlling the embodiments of FIG. 4 and 5.

The PDP of FIG. 4 is realised as AC-PDP having dielectric layers 15, 16. The black plate 18 has a very low reflectivity. The LC 17 is able to change the transmissivity and the reflectivity. Each cell position and size of the cells 17*a* are matched to the PDP dot position and size. Each cell is controllable by an LC controller, which is here part of an electronical control unit (ECU) 19 as shown in FIG. 6.

When the PDP dot emits light according to a picture to be displayed and accordingly controlled by the ECU 19, the reflecxtivity of the LC-cell 17*a* is changed to a high value by the ECU 19. Thereby the transmissivity is changed to low. Therefore emitted light from the PDP dot through the back-glass 2 is reflected by the LC 17 and passes as rays 10 into the direction of a viewer.

Figure 5:
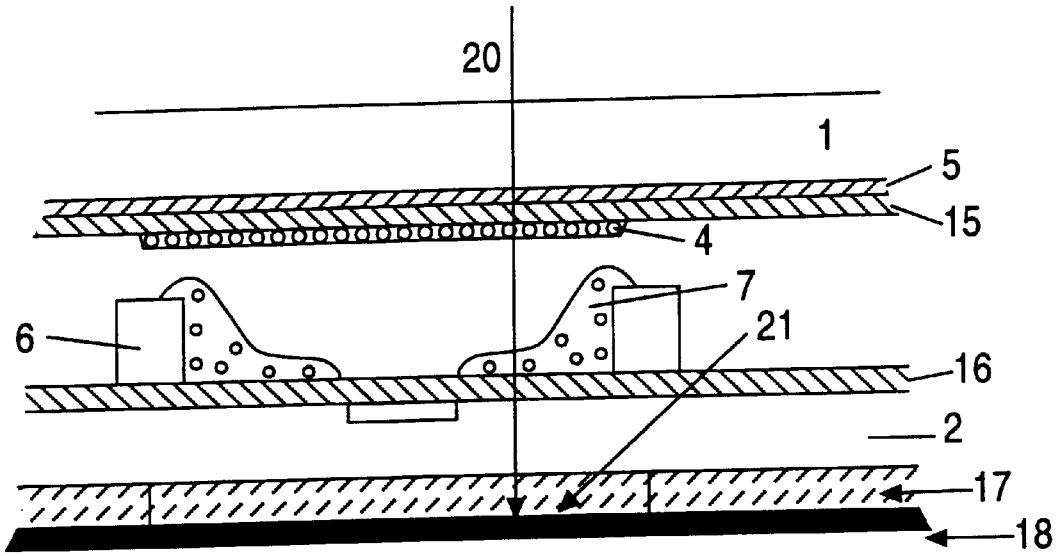
FIG. 5 shows the embodiment of FIG. 4 with noise light.

When the PDP dot does not emit light, which is controlled by the ECU 19 and shown in FIG. 5, the reflectivity of the LC-cell 17*a* is controlled as low and the transmissivity is changed to high. Therefore noise-light from outside as indicated by rays 20 or from other dots, indicated by rays 21, (FIG. 5) pass through the back-glass 2 and the LC 17 to the black plate 18. The reflectivity of plate 18 is very low whereby the noise-light 20, 21 is absorbed, may be partly or totally.

By the different modes which are controlled by ECU 19, the PDP contrast and luminace, and also the black level, are improved. It may also be mentioned that the LC 17 can be controlled such that the reflectivity has steps between the maximum and the minimum. That means any value of reflectivity or transmissivity, respectively, can be controlled by ECU 19.

I claim:

1. In a plasma display panel comprising a front plate and a back plate spaced apart from one another so that a discharge space is formed to accommodate a plurality of light generating display cells, the improvement comprising the back side of the plasma display panel of said display cells include a mirror layer having a controllable reflectivity which layer is realized as liquid crystal.

2. In a plasma display panel comprising a front plate and a back plate spaced apart from one another so that a discharge space is formed to accommodate a plurality of light generating display cells, the improvement comprising the back side of the plasma display panel of said display cells include a mirror layer having a controllable reflectivity, where said layer (17) is provided as cells (17*a*), each of said cells belonging to one PDP-cell.

3. A plasma display panel comprising a front plate and a back plate spaced apart from one another so that a discharge space is formed to accommodate a plurality of light generating display cells and a mirror layer on the back side of the plasma display panel, wherein the mirror layer is made of an electro-optical material, and wherein the electro-optical material is a liquid crystal.

4. The plasma display panel according to claim 3, wherein the mirror layer is provided as cells, each of said cells belonging to one PDP-cell.

5. The plasma display panel according to claim 4, wherein each cell of the mirror layer is connected to a controller.

6. The plasma display panel according to claim 5, wherein the controller operates so that the mirror layer has a high reflectivity when the plasma display panel has a high light value and that said mirror layer has a low reflectivity when the plasma display panel transmits a low light value.

* * * * *